US006827463B2

(12) United States Patent
Chuang et al.

(10) Patent No.: US 6,827,463 B2
(45) Date of Patent: Dec. 7, 2004

(54) REAR LIGHTING WITH REFLECTIVE SHELF SURFACES FOR SUPERMARKET DISPLAY CASE

(75) Inventors: Sue-Li "Kingsley" Chuang, Glastonbury, CT (US); Eugene Duane Daddis, Jr., Manlius, NY (US)

(73) Assignee: Carrier Commercial Refrigeration, Inc., Syracuse, NY (US)

( * ) Notice: Subject to any disclaimer, the term of this patent is extended or adjusted under 35 U.S.C. 154(b) by 0 days.

(21) Appl. No.: 10/264,959

(22) Filed: Oct. 2, 2002

(65) Prior Publication Data

US 2004/0066646 A1 Apr. 8, 2004

(51) Int. Cl.[7] ..... F25D 27/00
(52) U.S. Cl. ..... 362/92; 362/125
(58) Field of Search ..... 362/94, 92, 125, 362/126, 133, 294, 328; 62/246; 312/408

(56) References Cited

U.S. PATENT DOCUMENTS 6,558,017 B1 * 5/2003 Saraiji et al. ..... 362/125
2002/0162346 A1 * 11/2002 Chiang et al. ..... 62/246
2003/0038571 A1 * 2/2003 Obrock et al. ..... 312/408

* cited by examiner

*Primary Examiner*—Alan Cariaso
*Assistant Examiner*—Mark Tsidulko
(74) *Attorney, Agent, or Firm*—Carlson, Gaskey & Olds

(57) ABSTRACT

Refrigeration system has a display case defining a display space. The display space has a top area, a bottom area, a front viewing area, and a back area. A cooling element provides cool air to display space. An air outlet directs a cool air curtain to an air inlet, across the front viewing area. A light source is located near the back area away from the air curtain. A reflector is spaced from the light source and reflects light through the display space.

12 Claims, 2 Drawing Sheets

REAR LIGHTING WITH REFLECTIVE SHELF SURFACES FOR SUPERMARKET DISPLAY CASE

BACKGROUND OF THE INVENTION

This invention relates to a refrigerated display case.

Refrigerated display cases frequently have an open viewing area that permits consumers to reach into the display case to retrieve product, such as milk, eggs and other perishable items from a display space. The display case may have a cool air outlet at the top that directs air across the viewing area to an air inlet, a warm air return, at the bottom of the case, thereby creating an air curtain that insulates the interior of the display case from warm ambient air outside.

Typically, these display cases have shelves within the display space to support the refrigerated product. At the front of the shelf hangs a light to illuminate product within the case. Unfortunately, this light generates heat, warming air and product in the vicinity of the light. As a consequence, this light alters temperature distribution within the display space and causes the product temperature near the front of the display space to be high.

A need therefore exists for a display case that avoids the uneven temperature distribution caused by the location of the light near the air curtain.

SUMMARY OF THE INVENTION

The present invention locates display lighting away from the air curtain. In so doing, this source of heat is prevented from having a significant effect on the temperature of the product in the front of the display. Preferably, the light is placed near the back of the display space and away from the air curtain located at the front. To maintain light distribution across the display space, a reflector, such as a mirror, may be used to reflect light on the product. In this way, the effect of the light's heat on the air curtain is limited, promoting efficient operation of the refrigeration system, without sacrificing the quality of lighting for the display case.

The reflector may be mounted to a shelf to permit light to shine down on product below the shelf with the reflector. The shelf may have a mirror or other reflective surface to provide this illumination. Light accordingly continues to be distributed throughout the display space.

The refrigeration system may also have an air mover, such as a fan, that directs air through the display case. Driven by the air mover, air may pass through a cooling element, such as a refrigeration coil, to an air outlet that distributes air across the front of the display case in the form of an air curtain. The air curtain may then be received by an air inlet, a warm air return, which feeds the air back to a cooling element so that the air may be cooled down once more.

Accordingly, a display space may have a front viewing area and a back area. Air is cooled for the display space and directed across the viewing area. A light source is located away from the front area and near the back area. A reflector is spaced from the light source to reflect light across the display space.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
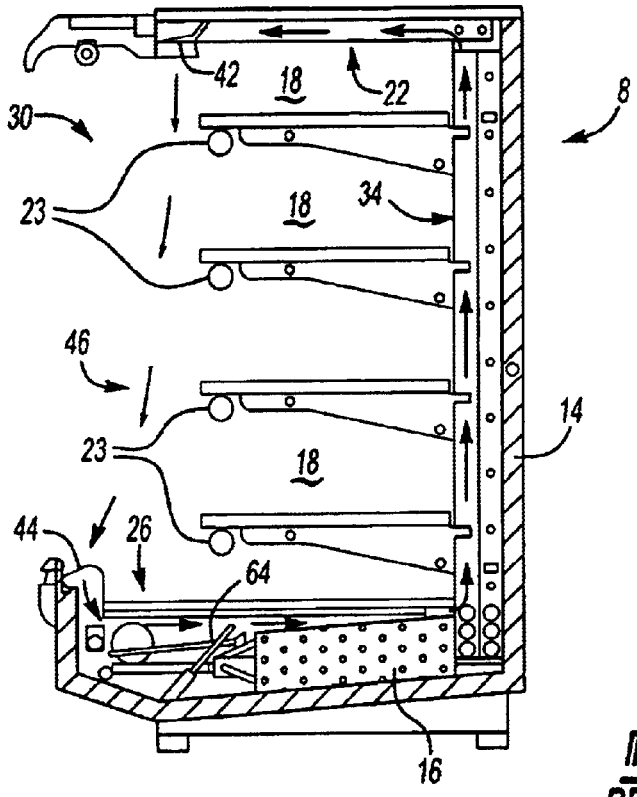
Fig-1 PRIOR ART
FIG. 1 illustrates a side view of a prior art refrigeration system.
Figure 2:
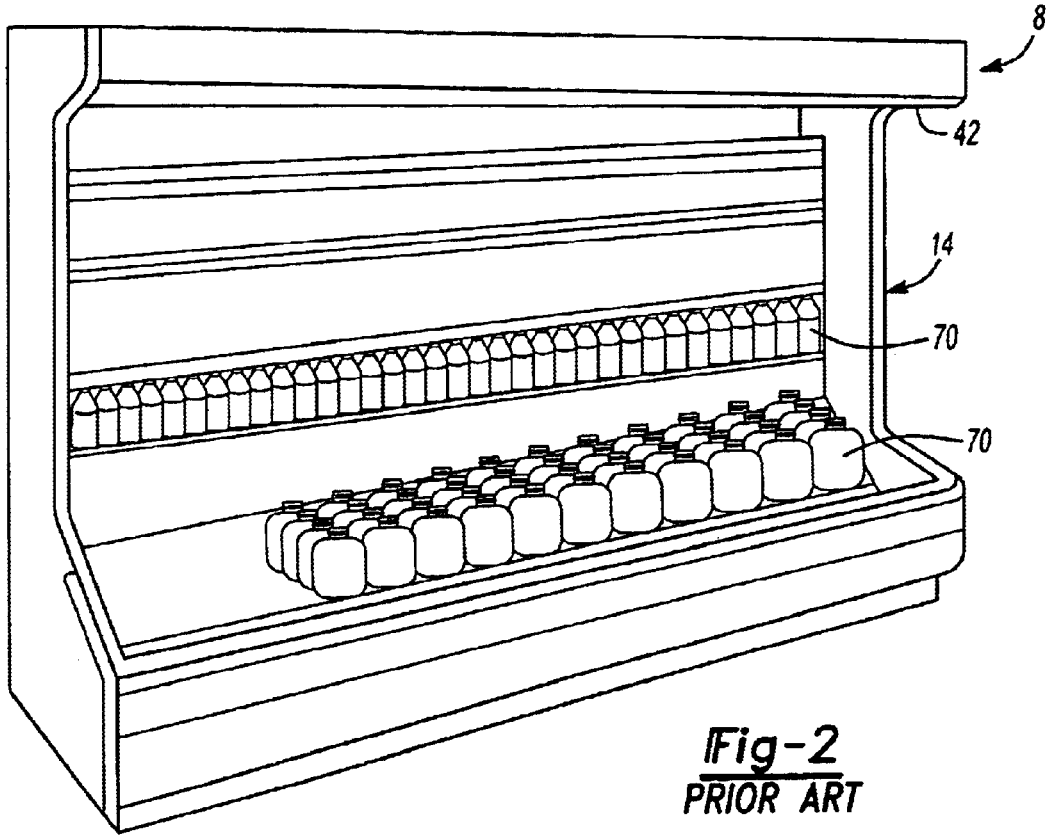
Fig-2 PRIOR ART
FIG. 2 illustrates a perspective view of the display case of FIG. 1.

FIG. 1 illustrates a side view of known refrigeration system 8. Display case 14 has cooling element 16, such as refrigeration coils, that provides display space 18 within display case 14 with cool air. Display space 18 comprises top area 22 spaced from bottom area 26 and front viewing area 30 spaced from back area 34. Cool air is supplied to display space 18 by air outlet 42, which distributes air uniformally across front viewing area 30 to form air curtain 46. Air curtain 46 is received by air inlet 44. Air is drawn into air inlet 44 by air mover 64, here a panel of fans, that then directs air over cooling element 16 through air outlet 42. FIG. 2 illustrates a perspective view of refrigeration system 8, showing the location of air outlet 42 and air inlet 44 on display case 14. This figure also shows product 70 on shelves 60. These features of refrigeration system 8 are well known.

FIG. 1 shows light sources 23 near front viewing area 30 and air curtain 46. Due to the proximity of light sources 23 near air curtain 46, heat from light sources 23 warms air near air curtain 46, altering temperature distribution with display space 18. Air curtain 46 consequently works harder to keep display space 18 cool.

Figure 3:
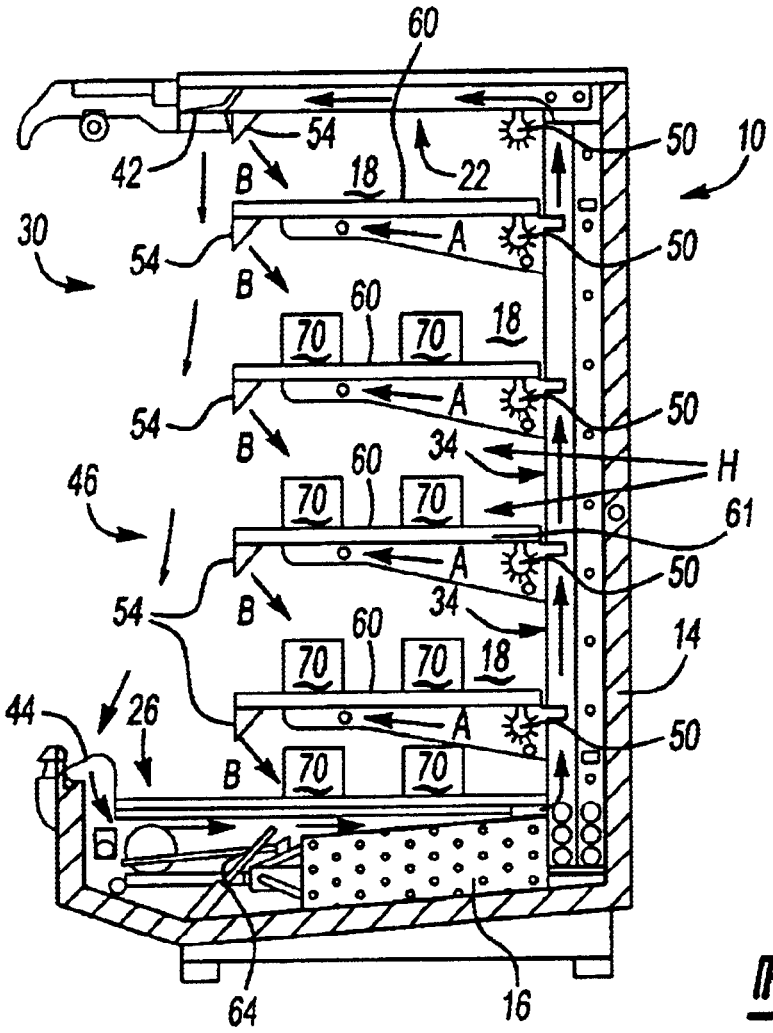
FIG. 3 illustrates a side view of the inventive refrigeration system, highlighting the location of light source and reflector.

As shown in FIG. 3, in contrast to existing refrigeration systems, refrigeration system 10 locates light source 50, such as light bulbs, proximate to back area 34 of display space 18. By moving the location of light source 50 away from air curtain 46, heat from light source 50 is prevented from significantly affecting the temperature of front viewing area 30 near air curtain 46. As a consequence, front viewing area 30 is kept cooler, permitting display case 14 to work more efficiently.

To enhance lighting at front viewing area 30, near the front of shelves 60, reflectors 54 are mounted to shelves 60. Reflectors 54 may comprise mirrors, reflective tape or other reflective surfaces. Reflectors 54 permit reflection of light from light source 50 shined along arrow A, from back area 34, to be redirected along arrow B, toward bottom area 26 and back area 34, and toward product 70 on the shelf beneath reflector 54. In this manner, light may be distributed through display space 18 without moving light source 50 closer to air curtain 46. As shown further in FIG. 3, light source 50 is located above anticipated height H of product 70 above shelf 61. While this particular embodiment shows reflector 54 placed at front of shelf 60, one of ordinary skill in the art can envision the placement of reflective surfaces at other locations within display space 18 to promote good lighting of display space 18 while avoiding the location of light source 50 near air curtain 46.

The aforementioned description is exemplary rather that limiting. Many modifications and variations of the present invention are possible in light of the above teachings. The preferred embodiments of this invention have been disclosed. However, one of ordinary skill in the art would recognize that certain modifications would come within the scope of this invention. Hence, within the scope of the appended claims, the invention may be practiced otherwise than as specifically described. For this reason the following claims should be studied to determine the true scope and content of this invention.

What is claimed is:

1. A refrigeration system comprising:

a display case defining a display space having a top area, a bottom area, a front viewing area, and a back area;

a cooling element in communication with said display space;

at least one air outlet in communication with said cooling element, said at least one air outlet for guiding an air curtain across said front viewing area; and a reflector spaced from a light source and located proximate said front area, with said light source spaced toward said back area from said reflector, said reflector for reflecting light through said display space.

2. The refrigeration system of claim 1 including a shelf within said display space wherein said reflector is mounted to said shelf.

3. The refrigeration system of claim 2 including an air mover directing air from said cooling element to said air outlet.

4. The refrigeration system of claim 3 wherein said air mover comprises a fan.

5. The refrigeration system of claim 1 including an air inlet in communication with said air outlet, said air inlet for receiving said air curtain.

6. The refrigeration system of claim 1 wherein said reflector comprises a mirror.

7. The refrigeration system of claim 1 wherein said reflector comprises a reflective tape.

8. The refrigeration system of claim 1 wherein said light source is located proximate said back area.

9. A method of refrigeration comprising:

providing a display space having a front viewing area and a back area;

cooling air for the display space;

directing the cool air across the front viewing area;

locating a light source away from the front viewing area spaced toward the back area;

spacing a reflector from the light source;

directing light from the light source to the reflector; and reflecting light into the display space from the reflector.

10. A refrigeration system comprising:

a display case defining a display space having a front viewing area and a back area;

a cooling element in communication with said display space;

at least one air outlet in communication with said cooling element, said at least one air outlet for guiding an air curtain across said front viewing area;

a first shelf within said display space wherein a reflector is mount on said first shelf; and a light source for emitting light from said back area to said reflector long said first shelf.

11. The refrigeration system of claim 10 including a second shelf spaced below said first shelf wherein said reflector is angled to reflect light on said second shelf.

12. The refrigeration system of claim 11 wherein said light source is located above an anticipated height of a product on said second shelf.

* * * * *

UNITED STATES PATENT AND TRADEMARK OFFICE

CERTIFICATE OF CORRECTION

PATENT NO. : 6,827,463 B2
DATED : December 7, 2004
INVENTOR(S) : Chuang et al.

It is certified that error appears in the above-identified patent and that said Letters Patent is hereby corrected as shown below:

Column 4,
Line 24, “mount” should read as -- mounted --.
Line 26, “long” should read as -- along --.

Signed and Sealed this

Nineteenth Day of April, 2005

JON W. DUDAS
*Director of the United States Patent and Trademark Office*